US008687025B2

(12) United States Patent
Lee et al.

(10) Patent No.: US 8,687,025 B2
(45) Date of Patent: Apr. 1, 2014

(54) DISPLAY DEVICE AND DRIVING METHOD THEREOF

(75) Inventors: Duk-Jin Lee, Yongin (KR); Soon-Ryong Park, Yongin (KR); Woo-Suk Jung, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 464 days.

(21) Appl. No.: 12/869,694

(22) Filed: Aug. 26, 2010

(65) Prior Publication Data

US 2011/0115832 A1 May 19, 2011

(30) Foreign Application Priority Data

Nov. 19, 2009 (KR) ..... 10-2009-0112208

(51) Int. Cl.
*G09G 5/10* (2006.01)

(52) U.S. Cl.
USPC ..... 345/690; 345/212

(58) Field of Classification Search
USPC ..... 345/39, 44–46, 204–215, 690–699, 345/55–111
See application file for complete search history.

(56) References Cited

U.S. PATENT DOCUMENTS

| | | | | |
|---|---|---|---|---|
| 7,046,225 | B2 * | 5/2006 | Chou | 345/92 |
| 7,903,052 | B2 * | 3/2011 | Kwak et al. | 345/76 |
| 2006/0001613 | A1 * | 1/2006 | Routley et al. | 345/76 |
| 2006/0077200 | A1 * | 4/2006 | Tamayama | 345/211 |
| 2007/0118781 | A1 * | 5/2007 | Kim | 714/727 |
| 2008/0018561 | A1 | 1/2008 | Song et al. | |
| 2008/0062088 | A1 * | 3/2008 | Chang et al. | 345/76 |
| 2009/0167781 | A1 * | 7/2009 | Nakata | 345/596 |
| 2009/0278774 | A1 * | 11/2009 | Chen et al. | 345/83 |
| 2010/0118002 | A1 * | 5/2010 | Yamashita et al. | 345/205 |

FOREIGN PATENT DOCUMENTS

| | | | |
|---|---|---|---|
| JP | 2003-228327 | A | 8/2003 |
| JP | 2006-065148 | A | 3/2006 |
| KR | 10-2004-0053640 | A | 6/2004 |
| KR | 10-2004-0066239 | A | 7/2004 |
| KR | 10-2007-0117378 | A | 12/2007 |
| KR | 10-2009-0084444 | A | 8/2009 |

* cited by examiner

*Primary Examiner* — Abbas Abdulselam
*Assistant Examiner* — Gerald Oliver
(74) *Attorney, Agent, or Firm* — Christie, Parker & Hale, LLP

(57) ABSTRACT

A display device includes: a panel including a plurality of pixel circuits, each of the pixel circuits including a light emitting element having one end coupled to a first voltage source for supplying a first voltage and another end coupled to a second voltage source for supplying a second voltage; a controller for reducing image data for one frame and for outputting a control signal and a data signal to display an image corresponding to the reduced image data on the panel; a voltage difference setting unit for detecting a peak value of the reduced image data and for calculating a driving voltage for generating a peak driving current corresponding to the peak value; and a power supply for generating the first and second voltages and for providing the first and second voltages to the panel in accordance with the driving voltage.

19 Claims, 8 Drawing Sheets

DISPLAY DEVICE AND DRIVING METHOD THEREOF

CROSS-REFERENCE TO RELATED APPLICATION

This application claims priority to and the benefit of Korean Patent Application No. 10-2009-0112208 filed in the Korean Intellectual Property Office on Nov. 19, 2009, the entire content of which is incorporated herein by reference.

BACKGROUND

1. Field

Aspects of embodiments according to the present invention relate to a display device and a driving method thereof.

2. Description of the Related Art

A display device includes a display panel including a plurality of pixel circuits arranged in a matrix. The display panel includes a plurality of scan lines formed in rows and a plurality of data lines formed in columns, and the plurality of scan lines and the plurality of data lines are arranged to cross each other. Each of the plurality of pixels is driven by a scan signal and a data signal transmitted from the corresponding scan line and data line and is also driven by a driving voltage.

Display devices are classified into a passive matrix type light emitting display and an active matrix type light emitting display depending on driving systems of (or used with) the pixels. The active matrix type light emitting display, which selectively turns on the light in every unit pixel, has been widely used because of beneficial aspects of resolution, contrast, and response time.

The display devices are used as displays for portable devices such as personal computers, portable phones, PDAs, etc., or as displays of various information appliances. Various display devices such as liquid crystal displays (LCDs) using a liquid crystal panel, organic light emitting displays using organic light emitting elements, and plasma display panels (PDPs) using a plasma panel, etc. are known in the art. In recent years, various light emitting displays have been developed that are more lightweight and have a smaller volume than a cathode ray tube, and in particular, an organic light emitting display device having excellent luminous efficiency, luminance, and viewing angle and a rapid response time has shown promise.

A pixel circuit of an active matrix organic light emitting display includes a driving transistor, and when current flowing through the driving transistor flows through an organic light emitting diode, the organic light emitting diode emits light corresponding to the current. The driving methods of the organic light emitting display include a driving method for controlling a driving transistor so as to operate in a saturation region.

The above information disclosed in this Background section is only for enhancement of understanding of the background of the invention and therefore it may contain information that does not form the prior art that is already known in this country to a person of ordinary skill in the art.

SUMMARY

Embodiments of the present invention provide a display device that may reduce power consumption by reducing driving voltage.

Embodiments of the present invention also provide a driving method of a display device that may reduce power consumption by reducing driving voltage.

A display device according to one exemplary embodiment of the present invention includes: a panel including a plurality of pixel circuits, each of the pixel circuits including a light emitting element having one end coupled to a first voltage source for supplying a first voltage and another end coupled to a second voltage source for supplying a second voltage; a controller for reducing image data for one frame and for outputting a control signal and a data signal to display an image corresponding to the reduced image data on the panel; a voltage difference setting unit for detecting a peak value of the reduced image data and for calculating a driving voltage for generating a peak driving current corresponding to the peak value; and a power supply for generating the first and second voltages and for providing the first and second voltages to the panel in accordance with the driving voltage, wherein the light emitting element of at least one of the pixel circuits is configured to receive the peak driving current.

The controller may include an automatic current limit (ACL) unit for receiving the image data for one frame, for reducing the image data to generate the reduced image data, and for outputting the reduced image data. The ACL unit may be configured to reduce the image data for one frame by a subtraction amount to generate the reduced image data. The ACL unit may also be configured to set the subtraction amount to a value that is proportional to the brightness of the image displayed on the panel in accordance with the image data for one frame. The image data may include gray level (or grayscale) data. The ACL unit may be configured to output the reduced image data having a gray level of 0 when a difference obtained by subtracting the subtraction amount from the corresponding image data has a negative value.

The ACL unit may be configured to reduce the image data for one frame by a scale factor (or proportion) to generate the reduced image data. The ACL unit may be configured to set the scale factor to a value that is proportional to the brightness of the image displayed on the panel in accordance with the image data for one frame.

The image data may comprise red (R), green (G), and blue (B) components of the image. The voltage difference setting unit may be configured to detect the peak value of the reduced image data, to calculate a peak luminance corresponding to the peak value using a gamma curve applied to the panel and the peak value, to calculate the peak driving current, and to calculate the driving voltage corresponding to the peak driving current.

The voltage difference setting unit may include: a peak value detector for receiving the reduced image data and for detecting a peak value of the reduced image data; and a driving voltage calculator for calculating the driving voltage corresponding to the peak driving current.

The driving voltage calculator may include: a peak driving current amount estimator for calculating a peak luminance corresponding to the peak value using a gamma curve applied to the panel and the peak value and for estimating a value of the peak driving current; and a voltage difference calculator for calculating the driving voltage in accordance with the estimated value of the peak driving current.

The voltage difference setting unit may further include a lookup table for storing information on a luminance value and a driving voltage corresponding to the luminance value. The voltage difference setting unit may determine the driving voltage corresponding to the peak value using the information stored in the lookup table.

Another exemplary embodiment of the present invention provides a driving method of a display device including a panel including a plurality of pixel circuits, each of the pixel circuits including a light emitting element having one end coupled to a first voltage source for supplying a first voltage and another end coupled to a second voltage source for supplying a second voltage. The driving method of this embodiment includes: reducing image data for one frame; detecting a peak value of the reduced image data; calculating a driving voltage to generate a peak driving current corresponding to the peak value; and generating the first and second voltages and providing the first and second voltages to the panel such that a voltage difference between the first and second voltages corresponds to the driving voltage.

In the reduction of the image data, the image data for one frame may be reduced by a subtraction amount to generate reduced image data. The subtraction amount may be a value that is proportional to the brightness of an image displayed on the panel by the image data for one frame. The image data may include gray level data, and the driving method may further include setting the reduced image data to gray level data having a value of 0 when a difference obtained by subtracting the subtraction amount from the corresponding image data has a negative value.

In the reduction of the image data, the image data for one frame may be reduced by a scale factor (or proportion). The scale factor may be set to a value that is proportional to the brightness of an image displayed on the panel by the image data for one frame. In the reduction of the image data, the image data for one frame may be reduced by a subtraction amount or by a scale factor.

The calculation of the driving voltage may include: calculating a peak luminance corresponding to the peak value using a gamma curve applied to the panel and the peak value and estimating a value of the peak driving current; and calculating the driving voltage corresponding to the estimated value of the peak driving current.

The method of driving may include storing information on a luminance value and a driving voltage corresponding to the luminance value.

In the calculation of the driving voltage, the driving voltage corresponding to the peak value may be determined using the stored information.

The display device according to one exemplary embodiment of the present invention can reduce driving voltage by performing automatic current limit (hereinafter, 'ACL') processing on input image data and by generating a driving voltage based on the ACL-processed image data. Accordingly, power consumption can be reduced.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
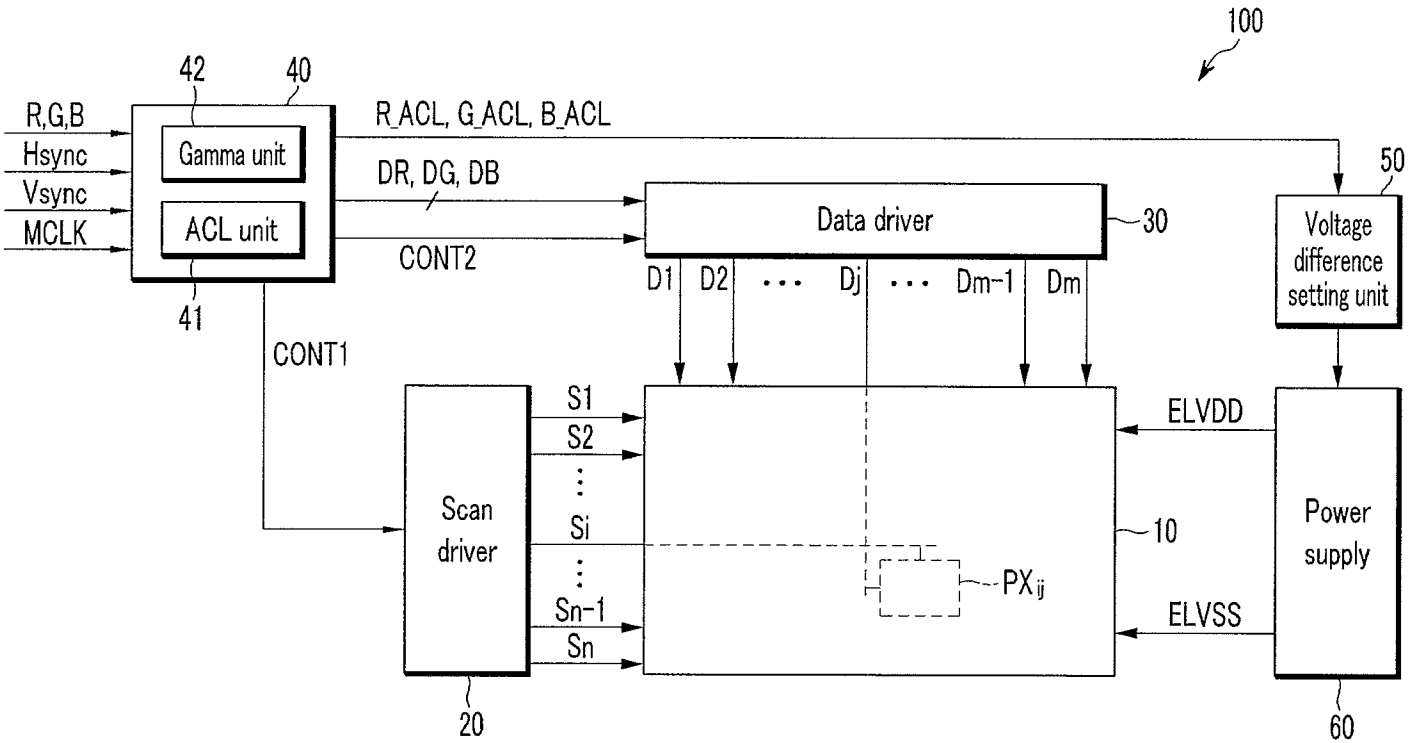
FIG. 1 is a block diagram showing a display device according to one exemplary embodiment of the present invention.

Hereinafter, exemplary embodiments of the present invention will now be described in detail with reference to the accompanying drawings such that those skilled in the art can carry out embodiments of the present invention. As those skilled in the art would realize, the described embodiments may be modified in various different ways, all without departing from the spirit or scope of the present invention.

Constituent elements having the same structures throughout the embodiments are denoted by the same reference numerals and are described in a first exemplary embodiment. In the other exemplary embodiments, only the constituent elements that differ from the first exemplary embodiment are described.

To clearly describe the exemplary embodiments of the present invention, some of the parts that are not required for a complete understanding of the described embodiments are omitted, and like reference numerals designate like constituent elements throughout the specification.

Throughout this specification and the claims that follow, when it is described that an element is "coupled" to another element, the element may be "directly coupled" to the other element or "electrically coupled" (or "indirectly coupled") to the other element through a third element. In addition, unless explicitly described to the contrary, the word "comprise" and variations such as "comprises" or "comprising" will be understood to imply the inclusion of stated elements but not the exclusion of any other elements.

In an active matrix organic light emitting display, a driving voltage with a margin (e.g., a predetermined margin) is supplied to the pixel circuits so that the driving transistors operate in their saturation region. As the luminance of an image becomes higher (or increases), the organic light emitting diode requires a larger (or more) current. In order for the driving transistor to generate a larger current and to operate in a saturation region, the drain-source voltage of the driving voltage may be increased. That is, in the case where a high luminance image is displayed, a driving voltage for driving the driving transistor in a saturation region may increase. An increase of the driving voltage may lead to increased power consumption.

An increase in the power supplied to the organic light emitting diode results in an increase in the overall power consumption of a personal computer, a portable phone, a PDA, or the like which includes an organic light emitting display, thus leading to consumer dissatisfaction (for example, due to reduced battery life).

Therefore, power consumption changes depending on the luminance of an image displayed on an organic light emitting display.

FIG. 1 is a block diagram showing a display device according to one exemplary embodiment of the present invention.

Referring to FIG. 1, a display device 100 includes a panel 10, a scan driver 20, a data driver 30, a signal controller 40, a voltage difference setting unit 50, and a power supply 60.

The panel 10 includes a plurality of signal lines S1-Sn and D1-Dm and a plurality of pixel circuits PX coupled thereto and arranged substantially in a matrix. The signal lines S1-Sn and D1-Dm include a plurality of scan lines S1-Sn for transmitting scan signals and a plurality of data lines D1-Dm for transmitting data signals. The scan lines S1-Sn extend substantially in a row direction and are substantially parallel to each other, while the data lines D1-Dm extend substantially in a column direction and are substantially parallel to each other. FIG. 1 illustrates only a pixel circuit PXij formed at the crossing region of an i-th scan line Si and a j-th data line Dj, by way of example.

The pixel circuit PXij includes a light emitting element (e.g., organic light emitting diode (OLED)). The light emitting element is coupled to the power supply 60 for supplying a first voltage ELVDD and a second voltage ELVSS. Specifically, the organic light emitting diode OLED has one end (or one terminal) electrically coupled to the first voltage ELVDD (or a first voltage source for supplying the first voltage ELVDD) and another end (or another terminal) electrically coupled to the second voltage ELVSS (or a second voltage source for supplying the second voltage ELVSS), and emits light (e.g., an amount of light) corresponding to the current flowing between the ends (e.g., terminals). Here, the current flowing between the terminals of the light emitting element is referred to as a driving current I_oled.

Each of the pixel circuits generates a driving current I_oled in response to a voltage data signal, the first voltage ELVDD, and the second voltage ELVSS and supplies the driving current to the organic light emitting diode. The organic light emitting diode emits light with brightness that is proportional to the driving current I_oled. Here, the first voltage ELVDD is higher than the second voltage ELVSS.

The signal controller 40 receives image data R, G, and B, a horizontal synchronization signal Hsync, a vertical synchronization signal Vsync, and a clock signal MCLK, and outputs a scan control signal CONT1, a data control signal CONT2, and image data signals DR, DG, and DB corresponding to the image data R, G, and B that are used to display an image in accordance with the image data R, G, and B on the panel 10. Here, the image data R, G, and B include a plurality of gray level data for controlling the luminance of each of the plurality of pixels.

The signal controller 40 may include an automatic current limit (ACL) unit 41 and a gamma unit 42.

The ACL unit 41 receives image data R, G, and B for one frame and modifies (e.g., reduces) the data. Here, the reduction refers to reducing the size (e.g., reducing the magnitudes of the values of the data) of the image data R, G, and B. Data outputted from the ACL unit 41 after ACL processing is performed thereon may be referred to as reduced image data R_ACL, G_ACL, and B_ACL.

The gamma unit 42 receives the reduced image data R_ACL, G_ACL, and B_ACL, and generates luminance information corresponding to the reduced image data R_ACL, G_ACL, and B_ACL according to a gamma curve applied to the panel 10. Here, the gamma curve represents a relationship between luminance characteristics of image data.

The signal controller 40 calculates a driving current (I_oled of FIG. 2) based on the luminance information generated by the gamma unit 42, and generates image data signals DR, DG, and DB for supplying the calculated I_oled to the organic light emitting diode.

The voltage difference setting unit 50 detects a peak value of the reduced image data R_ACL, G_ACL, and B_ACL output from the ACL unit 41, and calculates a voltage difference between the first voltage ELVDD and the second voltage ELVSS so as to generate a driving voltage corresponding to the detected peak value. Here, the peak value refers to the size of the reduced image data R_ACL, G_ACL, and B_ACL representing the peak luminance of the reduced image data R_ACL, G_ACL, and B_ACL for one frame.

The image data R, G, and B represents red (R), green (G), and blue (B) data, respectively. The ACL unit 41 reduces the image data R, G, and B. The degree of reduction of the image data may vary according to the color that the data corresponds to. Also, the voltage difference setting unit 50 detects a peak value of each of the reduced image data of red, green, and blue R_ACL, G_ACL, and B_ACL.

The voltage difference setting unit 50 will be described in detail with reference to FIG. 3.

The power supply 60 generates the first voltage ELVDD and the second voltage ELVSS such that a voltage difference between the first voltage ELVDD and the second voltage ELVSS corresponds to the voltage difference (or driving voltage) calculated by the voltage difference setting unit 50. For example, if the voltage difference between the first voltage ELVDD and the second voltage ELVSS is Vdelta, the second voltage ELVSS can be set to one value (e.g., a predetermined value) and the first voltage ELVDD can be set to another value obtained by adding Vdelta to the second voltage ELVSS. Alternatively, the first voltage ELVDD can be set to one value (e.g., a predetermined value) and the second voltage ELVSS can be set to another value obtained by subtracting Vdelta from the first voltage ELVDD. A data voltage range is taken into consideration in setting the first voltage and the second voltage.

The scan driver 20 generates a plurality of scan signals Scan1-Scann in response to a scan control signal CONT1 and supplies the scan signals to scan lines S1-Sn. The plurality of scan signals Scan1-Scann are signals for transmitting a plurality of data signals Vdata1-Vdatam to the plurality of data lines. That is, when an enable scan signal is transmitted to one of the plurality of scan lines, a plurality of data signals are transmitted to the plurality of pixel circuits PX coupled to the scan line and written in each of the pixel circuits PX coupled to the scan line.

The data driver 30 receives the image data signals DR, DG, and DB output from the signal controller 40, and generates a plurality of data signals for one scan line in response to data signals DR, DG, and DB. The data driver 30 transmits the plurality of data signals generated in response to a data control signal CONT2 to the plurality of data lines D1-Dm.

The scan control signal CONT1 and the data control signal CONT2 are synchronized with each other. Therefore, when the scan driver applies an enable scan signal to one of the plurality of scan lines in response to a scan control signal, the data driver transmits a plurality of data signals corresponding to the scan line to which the enable scan signal is applied to the corresponding data lines.

Figure 2:
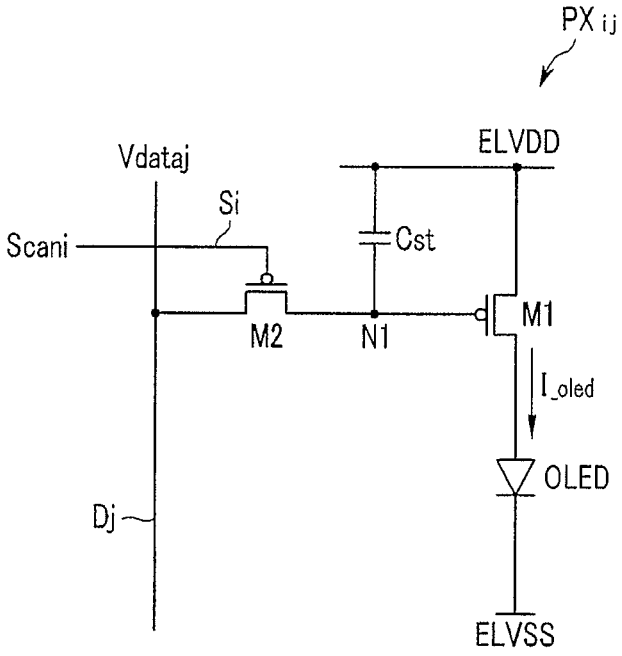
FIG. 2 is a circuit diagram showing in detail a pixel circuit which may be used with the embodiment of FIG. 1.

FIG. 2 is a view showing in detail a pixel circuit PXij of FIG. 1.

Referring to FIG. 2, a pixel circuit PXij is coupled to an i-th scan line Si and a j-th data line Dj and includes a light emitting element coupled between a first voltage ELVDD and a second voltage ELVSS. FIG. 2 illustrates an organic light emitting diode (OLED) as the light emitting element by way of example.

The pixel circuit PXij further includes a driving transistor M1, a capacitor Cst, and a switching transistor M2. Here, the driving transistor M1 and the switching transistor M2 may be P-type metal oxide semiconductor (PMOS) transistors.

The driving transistor M1 includes a source terminal coupled to the first voltage ELVDD, a gate terminal coupled to a first node N1, and a drain terminal coupled to an anode terminal of the organic light emitting diode OLED. The switching transistor M2 includes a source terminal for receiving a voltage data signal Vdataj, a gate terminal for receiving a scan signal Scani, and a drain terminal coupled to the gate terminal of the driving transistor M1 (e.g., through the first node N1).

The capacitor Cst is coupled between the first voltage ELVDD and the first node N1 and stores a voltage in accordance with the voltage difference between the voltage data signal Vdataj and the first voltage ELVDD.

As for the operation of the pixel circuit PXij, first, an enable scan signal Scani is transmitted to the gate terminal of the switching transistor M2. Then, the switching transistor M2 is turned on. A data signal Vdataj is transmitted to the first node N1 through the turned-on switching transistor M2, and the capacitor Cst is charged with a voltage corresponding to the voltage difference between the voltage data signal Vdataj and the first voltage ELVDD.

Then, the driving transistor M1 allows a driving current I_oled, which varies with the voltage stored in the capacitor, to flow to the organic light emitting diode OLED. The organic light emitting diode OLED emits light (or an amount of light) in accordance with the driving current I_oled. That is, the larger the driving current I_oled, the greater the amount of light emitted by the organic light emitting diode OLED.

The first voltage and the second voltage are determined by a peak luminance. The peak luminance refers to a highest luminance value among the luminance values displayed by all of the organic light emitting diodes of the organic light emitting display in a frame. The peak luminance may vary (or may be different) for each frame. The brighter an image, the higher the peak luminance.

The driving transistor according to one exemplary embodiment of the present invention is configured to operate in a saturation region and to supply current to the organic light emitting diode OLED in response to a data signal. When a data signal is transmitted to a gate electrode, if the voltage between the drain and source terminals is greater than a threshold (e.g., a predetermined threshold), the driving transistor operates in the saturation region.

A first voltage is applied to the source terminal of the driving transistor, and a voltage of the drain terminal is determined by a second voltage (e.g., applied to the drain terminal through the OLED). When the voltage range of a data signal is set, the voltage difference between the first voltage and the second voltage should be set to a voltage that is greater than a threshold voltage (e.g., a saturation voltage of the driving transistor) in order to operate the driving transistor in a saturation region. The higher the luminance, the larger the current generated by the driving transistor should be. Thus, when the peak luminance is large, there should be a large voltage difference between the source terminal voltage and the gate terminal voltage of the driving transistor.

Therefore, the higher the peak luminance, the higher the voltage difference between the first voltage and the second voltage such that the voltage difference is greater than a threshold voltage such that the driving transistor operates in the saturation region.

In some driving methods, the first voltage and the second voltage are not set according to the peak luminance of each frame, so the luminance range is fixed and the first voltage and the second voltage are set according to the fixed luminance range. Therefore, when the peak luminance of a frame is low, the voltage difference between the first voltage and the second voltage is set to (or fixed at) an unnecessarily large value, thereby causing unnecessary power consumption.

Specifically, when the driving transistor generates a driving current in response to a data signal, the voltage difference between the first voltage and the second voltage is distributed in accordance with a ratio of the ON resistance of the driving transistor to the resistance of the organic light emitting diode (i.e., part of the voltage drop between the first voltage and the second voltage appears across the driving transistor and another part appears across the organic light emitting diode). Therefore, if the voltage difference between the first voltage and the second voltage is greater than necessary for the desired output luminance, then the drain-source voltage of the driving transistor and the voltage across the organic light emitting diode are greater than necessary.

Power consumption of the driving transistor is determined by the current flowing through the driving transistor and the voltage difference between the drain electrode and the source electrode. Thus, for a given current, power consumption increases with an increase in drain-source voltage. Even when a low driving current flows, if the first voltage and the second voltage are fixed, the drain-source voltage may be higher than necessary. Therefore, power may be unnecessarily consumed by the driving transistor.

Because the voltage across the organic light emitting diode is also higher than necessary even when a low driving current flows, power is also unnecessarily consumed by the organic light emitting diode.

Accordingly, when the second voltage and the first voltage are set according to the fixed luminance range (e.g., a maximum luminance range), when the organic light emitting diode emits light at a luminance lower than the maximum luminance of the fixed luminance range, the driving transistor and the organic light emitting diode unnecessarily consume power.

To reduce or prevent unnecessary power consumption, in an exemplary embodiment of the present invention, the voltage difference between the first voltage and the second voltage is adjusted according to the peak luminance for each frame, thereby reducing unnecessary power consumption.

Specifically, an organic light emitting display according to one exemplary embodiment of the present invention can reduce power consumption by setting the first voltage ELVDD and the second voltage ELVSS to values (or optimized values) based on reduced image data R_ACL, G_ACL, and B_ACL which is output from the automatic current limit (ACL) unit. Hereinafter, the display device 100 according to one exemplary embodiment of the present invention will be described in detail with reference to FIG. 3.

Figure 3:
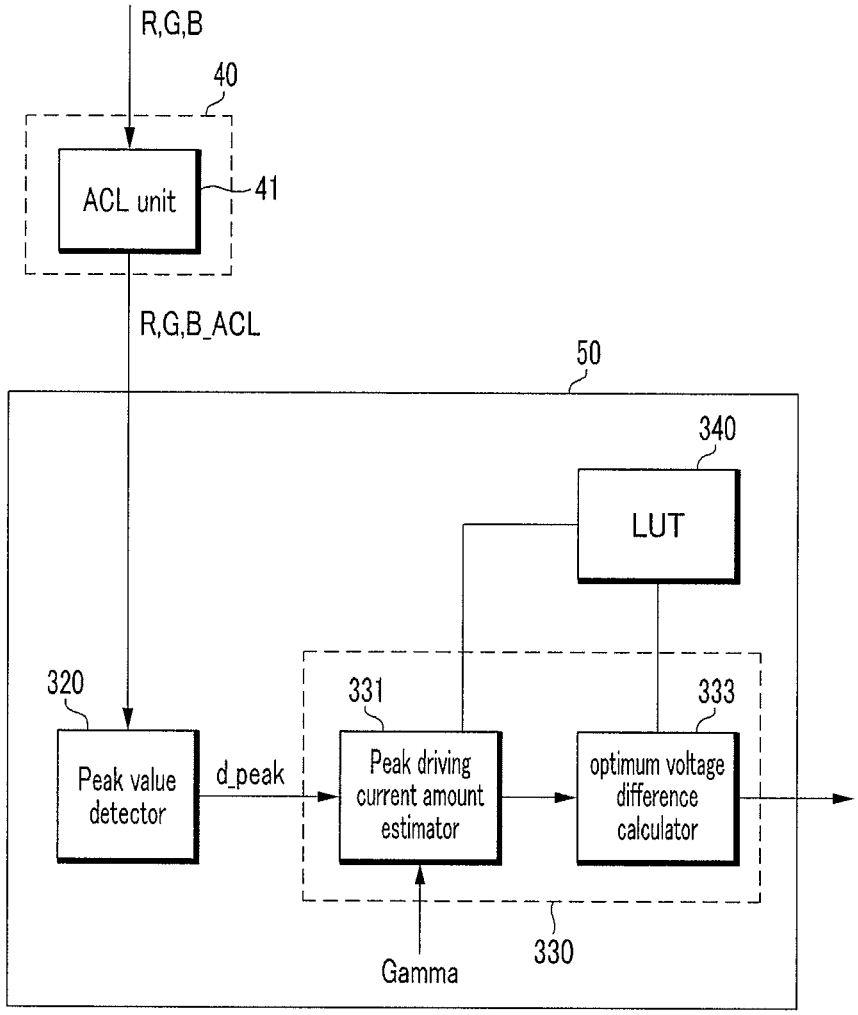
FIG. 3 is a block diagram view showing in detail an automatic current limit (ACL) unit and a voltage difference setting unit of FIG. 1.

FIG. 3 is a block diagram view showing in detail the ACL unit and voltage difference setting unit of FIG. 1.

Referring to FIG. 3, the ACL unit 41 reduces the image data R, G, and B for one frame. Specifically, in the case where all light emitting elements provided in the panel 10 emit light at a high luminance in accordance with image data R, G, and B for one frame, the ACL unit 41 reduces the size (e.g., reducing the magnitude of the data) of the input image data R, G, and B so as to lower the luminance of the entire screen. As a result, the luminance of the entire image displayed on the panel 10 is decreased.

The operation of the ACL unit 41 for reducing image data R, G, and B can be done in two ways, which will be described in detail below with reference to FIG. 4. The following FIGS. 4 and 5 illustrate the case where image data R, G, and B are gray level data (or gray levels) having a range from 0 to 255.

Figure 4:
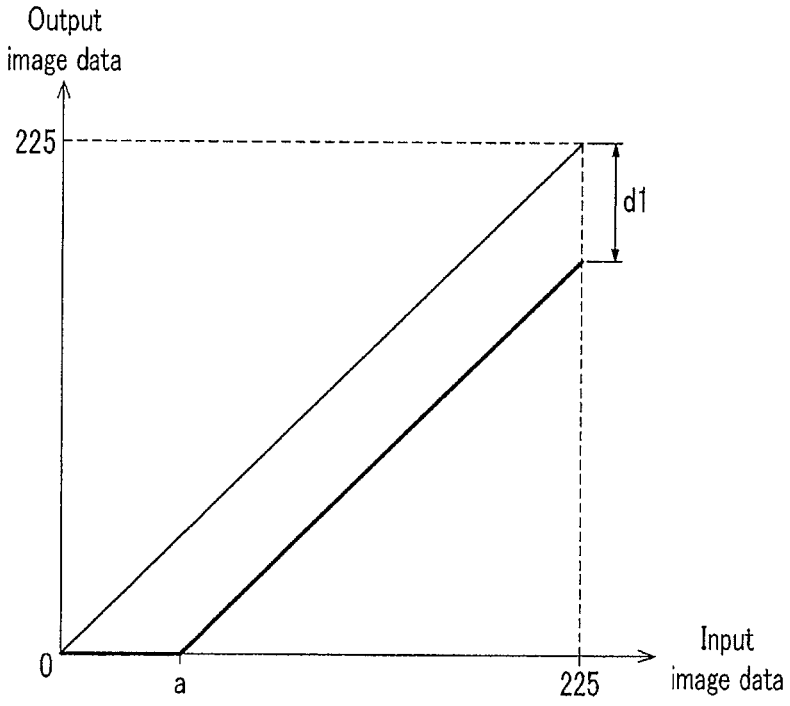
FIG. 4 is a graph for explaining an ACL processing operation of the ACL unit according to one exemplary embodiment of the present invention.
Figure 5:
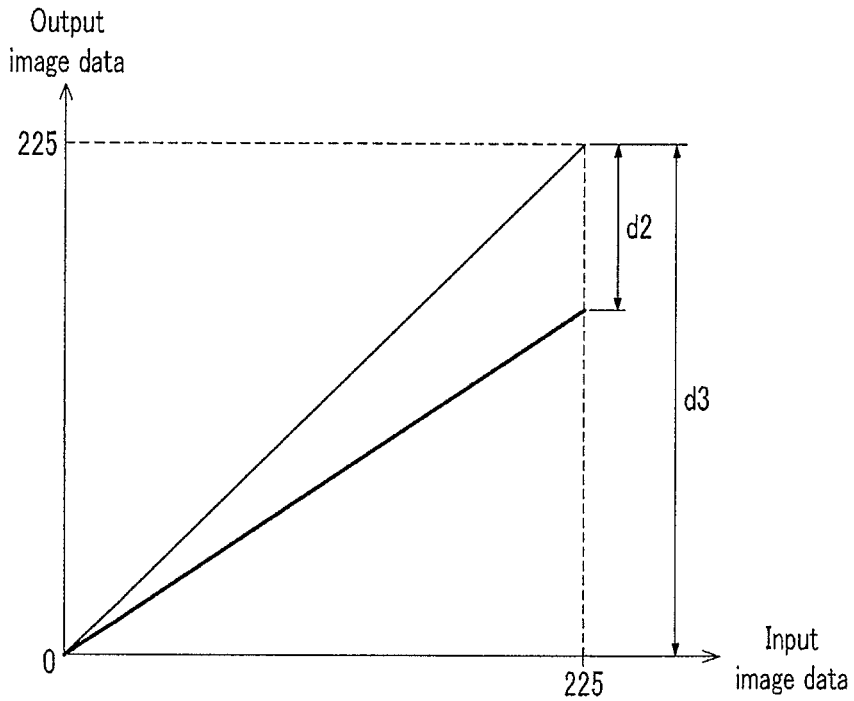
FIG. 5 is a graph for explaining an ACL processing operation of the ACL unit according to one exemplary embodiment of the present invention.

FIG. 4 is a graph for explaining a first ACL processing operation of the ACL unit according to one exemplary embodiment of the present invention.

Referring to FIG. 4, the x-axis represents the values of input image data R, G, and B, and the y-axis represents the values of reduced image data R_ACL, G_ACL, and B_ACL, i.e., image data output after ACL processing is performed thereon. Referring to FIG. 4, the ACL unit 41 can reduce the values of image data R, G, and B for one frame by a subtraction amount d1.

Here, the subtraction amount d1 is set to a value that is proportional to the size (or value) of the entire image data (or all of the image data) R, G, and B displayed on the panel. However, for a display device that has to realize a high luminance and display a high-quality image, the subtraction amount d1 can be set to a smaller value than that of a typical display device. That is, the subtraction amount d1 is a value that may vary according to input image data and the product specifications (e.g., the desired image quality) of the display device. For instance, for the same display device, if the luminance of a screen displayed based on image data is high, a subtraction amount may be set to a high value, and if the luminance of the screen is low, the subtraction amount may be set to a low value.

If the difference obtained by subtracting the subtraction amount from the image data has a negative value, the ACL unit 42 can output reduced image data R_ACL, G_ACL, and B_ACL corresponding to the negative values as having a gray level of 0. Therefore, the value of the reduced image data R_ACL, G_ACL, and B_ACL in the section between 0 and a on the x-axis is output as having a gray level of 0.

FIG. 5 is a graph for explaining an ACL processing operation of the ACL unit according to another exemplary embodiment of the present invention.

In FIG. 5, the x-axis and the y-axis are the same as those of FIG. 4. Referring to FIG. 5, the ACL unit 41 can reduce each of image data R, G, and B for one frame by a first scale factor (or proportion) d2/d3.

Here, like the subtraction amount d1 of FIG. 4, the first scale factor d2/d3 is set to a value proportional to the size (or value) of the entire image data (or all of the image data) R, G, and B displayed on the panel. Moreover, for a high-quality display device (or to output a high quality image), the scale factor d2/d3 can be set to a low value.

The voltage difference setting unit 50 includes a peak value detector 320 and a driving voltage calculator 330.

The ACL unit 41 reduces the image data R, G, and B forming one frame and transmits the reduced image data to the peak value detector 320. The peak value detector 320 receives a plurality of reduced image data R_ACL, G_ACL, and B_ACL. Then, a peak value d_peak is detected from the reduced image data R_ACL, G_ACL, and B_ACL. Thus, the peak value detector 320 detects a peak value d_peak of one frame.

For instance, suppose that there is image data R, G, and B with a peak gray level of 240 among image data R, G, and B forming one frame. The ACL unit 41 reduces the image data R, G, and B having a peak gray level of 240 by a first scale factor (e.g., 20%) as shown, for example, in FIG. 5. After the reduction, the peak gray level is reduced to 192 (240−(240×0.2)) which is the peak value d_peak of the reduced image data R_ACL, G_ACL, and B_ACL, the peak value detector 320 detects the gray level of 192 as the peak value d_peak.

The driving voltage calculator 330 calculates a voltage difference between the first voltage ELVDD and the second voltage ELVSS so as to generate a peak driving current I_oledp corresponding to the peak value d_peak. For example, if the detected peak value d_peak corresponds to image data having a gray level of 192, the peak driving current I_oledp is calculated so as to generate a luminance corresponding to a gray level of 192. Also, the voltage difference between the first voltage ELVDD and the second voltage ELVSS is calculated so as to generate the peak calculated driving current I_oledp. That is, the driving voltage calculator 330 sets the voltage difference between the first voltage ELVDD and the second voltage ELVSS in accordance with the peak value d_peak of the reduced image data R_ACL, G_ACL, and B_ACL.

The driving voltage calculator 330 may include a peak driving current amount estimator 331 and an optimum voltage difference calculator 333. The configuration and operation of the driving voltage calculator 330 will be described below with reference to FIGS. 6 and 7.

Figure 6:
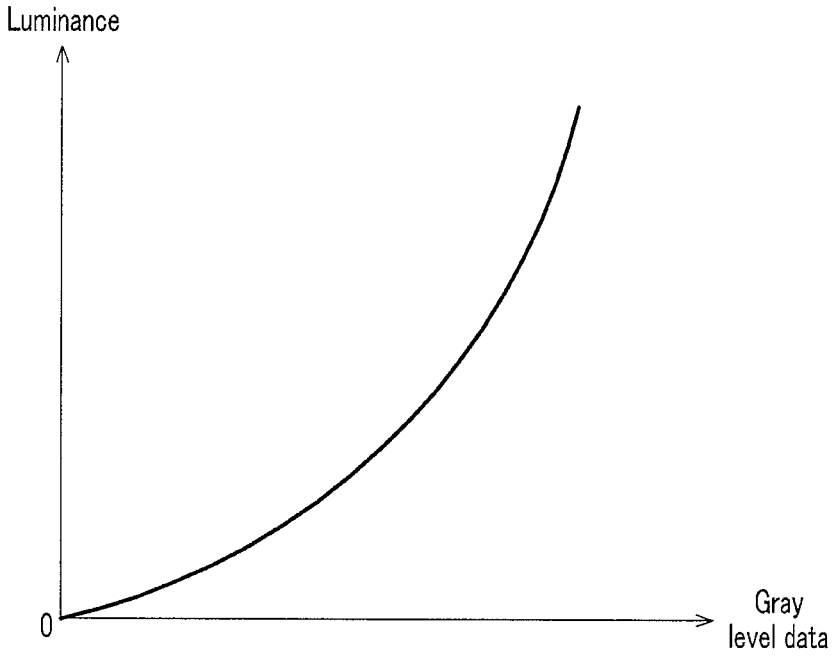
FIG. 6 is a graph showing a gamma curve according to one exemplary embodiment of the present invention.

FIG. 6 is a graph showing a gamma curve according to one exemplary embodiment of the present invention.

Referring to FIG. 6, the x-axis of the gamma curve represents the value of image data R, G, and B to be displayed, and the y-axis represents the luminance value of a screen where the corresponding image data is displayed. Here, since the image data is represented as gray level data, the x-axis in FIG. 6 is indicated as gray level data. The gamma curve may have a different shape for each product model of the display device, and may have a specific shape set by a user.

Figure 7:
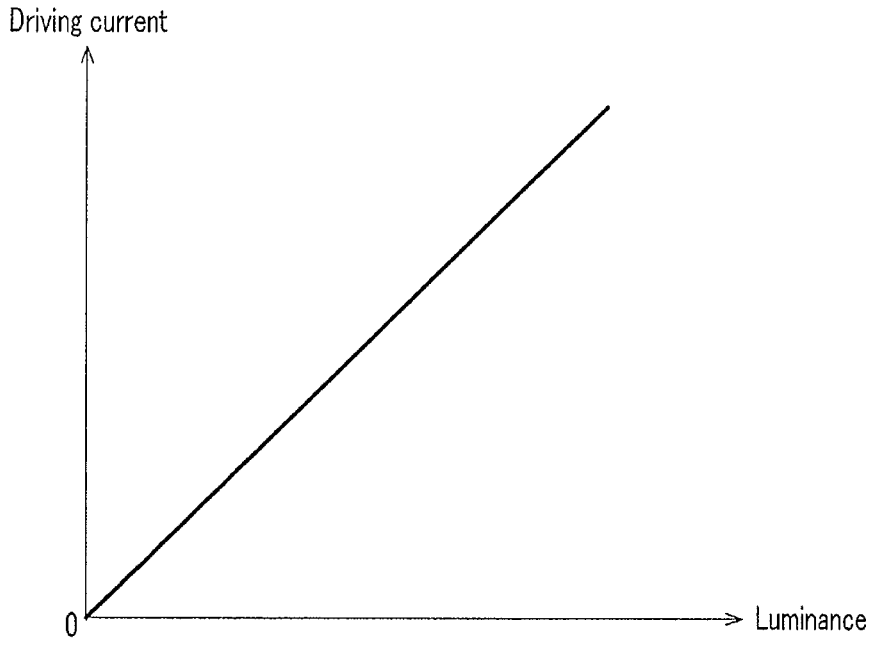
FIG. 7 is a graph showing the relationship between luminance and driving current according to one exemplary embodiment of the present invention.

FIG. 7 is a graph showing a relationship between luminance and driving current according to one exemplary embodiment of the present invention.

Referring to FIG. 7, the x-axis represents a luminance value, and the y-axis represents the value of a driving current (I_oled of FIG. 2) for generating a specific luminance value. The luminance value and the value of the driving current I_oled are proportional to each other. That is, in order to obtain high luminance, the value of the driving current should be increased. Referring to FIGS. 6 and 7, if a gray level value of image data R, G, and B is known, the corresponding luminance value can be obtained using a gamma curve. Moreover, once the luminance value is known, a corresponding driving current I_oled can be obtained (or determined).

The peak driving current amount estimator 331 obtains a luminance value (hereinafter, 'peak luminance value') corresponding to the peak value d_peak using the gamma curve applied to the panel 10 and the peak value d_peak detected by the peak value detector 320. Also, the value of the peak driving current I_oledp for producing the peak luminance value is calculated. The value of the driving current I_oled for producing the maximum luminance value is hereinafter referred to as a 'peak driving current' (I_oledp).

The optimum voltage difference calculator 333 calculates a driving voltage difference between the first voltage ELVDD and the second voltage ELVSS so as to generate the calculated peak driving current.

The voltage difference setting unit 50 according to the exemplary embodiment of the present invention includes a lookup table 340 for storing information on driving voltage differences (ELVDD−ELVSS) corresponding to peak driving currents.

The optimum voltage difference calculating unit 333 detects a driving voltage difference corresponding to the peak driving current from the lookup table 340, and determines the first voltage ELVDD and the second voltage ELVSS in accordance with the driving voltage difference. Information on the thus determined first voltage ELVDD and second voltage ELVDD is transmitted to the power supply 60. The voltage difference between the first voltage ELVDD and the second voltage ELVSS is hereinafter referred to as a 'driving voltage'. That is, the driving voltage is the voltage difference between the first voltage ELVDD and the second voltage ELVSS that are supplied to the pixel circuit PXij such that the driving transistor M1 supplying current to the organic light emitting diode OLED supplies the peak driving current I_oledp while operating in the saturation region.

For instance, a voltage difference of "A" volts between the gate electrode and the source electrode of the driving transistor M1 may be required to display a gray level of 192, and the first voltage ELVDD only needs to be higher by A than the voltage Vdataj of a data signal displaying the gray level of 192. However, a voltage difference of "B" volts between the gate electrode and the source electrode of the driving transistor may be required to display a gray level of 240, wherein B is greater than A (i.e., a greater driving voltage is needed to output higher current levels corresponding to higher gray levels). Thus, when displaying a gray level of 240, the first voltage ELVDD is set to a value that is higher than when displaying the gray level of 192. Conventionally, the first voltage ELVDD is set (or fixed) in accordance with the peak gray level of 255, so power consumption may be very high. Electric power is calculated by multiplying a voltage by a current. Therefore, for a given driving current, power consumption increases with the increase of driving voltage.

In one embodiment of the present invention, a minimum driving voltage for supplying a peak driving current corresponding to the peak luminance of an image for a frame is supplied to the pixel circuits during the frame, thereby reducing or minimizing power consumption.

Here, the driving voltage calculator 330 can omit a process of obtaining the peak driving current and can determine a driving voltage corresponding to the peak luminance value directly from the lookup table 340. The lookup table 340 stores information on the driving voltage corresponding to the peak luminance value. That is, in this embodiment, the driving voltage calculator 330 does not include the peak driving current amount estimator 331, but includes only the optimum voltage difference calculator 333. The optimum voltage difference calculator 333 obtains the peak luminance value corresponding to the peak value d_peak, and determines a driving voltage corresponding to the peak luminance value using the lookup table 340.

In an image display operation of the display device 100 according to one exemplary embodiment of the present invention, first, the signal controller 40 of the display device 100 receives image data R, G, and B, and performs ACL processing (executed by the ACL unit 41 provided in the display device 100) thereon, thus generating reduced image data R_ACL, G_ACL, and B_ACL. The gamma unit 42 converts the reduced image data R_ACL, G_ACL, and B_ACL into image data signals DR, DG, and DB and outputs them to the data driver 30. Moreover, the voltage difference setting unit 50 calculates a driving voltage using the reduced image data R_ACL, G_ACL, and B_ACL output from the ACL unit 41.

The power supply 60 generates a first voltage ELVDD and a second voltage ELVSS using the driving voltage calculated by the voltage difference setting unit 50 and supplies them to the panel 10.

The data driver 30 generates a data voltage (e.g., Vdataj) corresponding to image data signals DR, DG, and DB so as to display an image corresponding to the data signals DR, DG, and DB. Here, the data voltage Vdataj is a voltage signal and is input into a pixel circuit (e.g., PXij) of the panel 10. The pixel circuit PXij generates a driving current I_oled, which varies according to the data voltage Vdataj, the first voltage ELVDD, and the second voltage ELVSS, and the organic light emitting diode OLED emits light corresponding to the driving current I_oled.

In some display devices, such as a display device having a maximum luminance of 300 nit (a unit of luminance), the driving voltage is set with respect to 300 nit. That is, the driving voltage has a value corresponding to the maximum luminance (e.g., 300 nit) and is continuously supplied to the panel. Therefore, a driving voltage having a maximum value is continuously supplied (i.e., even when the image to be displayed does not require maximum luminance), resulting in continuous (or potentially unnecessary) power consumption.

In a display device according to one embodiment of the present invention, image data forming one frame is reduced, and the driving voltage is set with respect to the peak value of the reduced image data. Thus, the value of the driving voltage can be reduced in proportion to the proportion or amount of the reduced image data. That is, the overall power consumption of the display device 100 can be reduced by reducing the driving voltage supplied to the panel 10.

Figure 8:
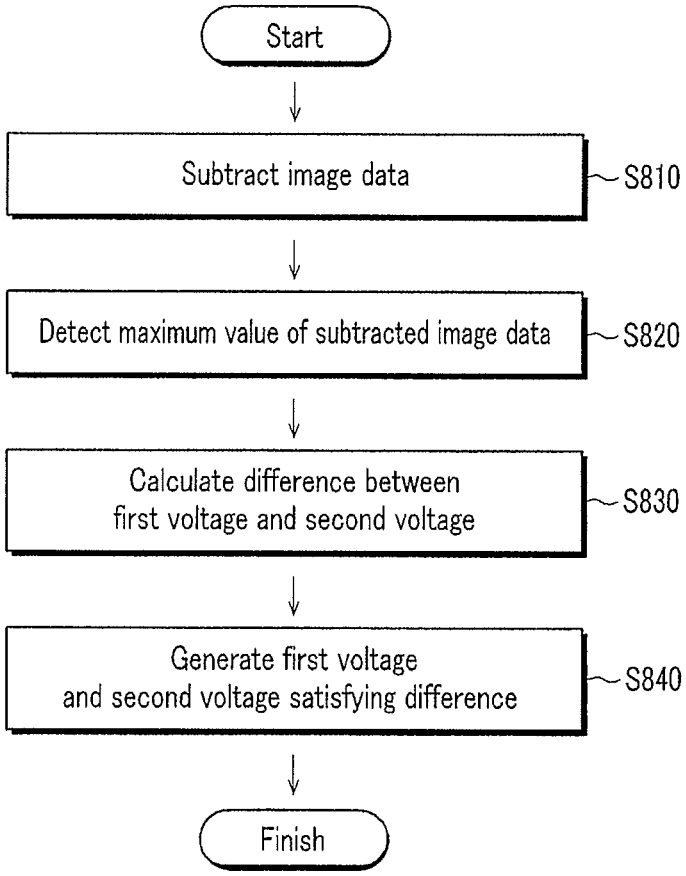
FIG. 8 is a flowchart showing a driving method of a display device according to one exemplary embodiment of the present invention.

FIG. 8 is a flowchart showing a driving method of a display device according to one embodiment of the present invention. Hereinafter, a driving method of a display according to another exemplary embodiment of the present invention will be described in reference to FIG. 8 and the above-described FIGS. 1 and 2.

Referring to FIG. 8, the driving method of the display device according to another exemplary embodiment of the present invention is a driving method of a display device having a panel including an organic light emitting diode OLED emitting light using a driving current I_oled.

First, image data for one frame is reduced (S810).

Then, a peak value is detected from the reduced image data (S820).

In S820, a voltage difference between a first voltage ELVDD and a second voltage ELVSS is calculated so as to generate a peak driving current I_oledp corresponding to the peak value detected in S820 (S830). The voltage difference between the first voltage ELVDD and the second voltage ELVSS is referred to as a driving voltage.

Then, the first voltage ELVDD and the second voltage ELVSS are generated and output to the panel 10 so as to satisfy the voltage difference between the first voltage ELVDD and the second voltage ELVSS (i.e., the driving voltage is output to the panel 10) (S840).

The driving method of the display device according to another exemplary embodiment of the present invention may further include a step of storing information of a luminance value and the voltage difference between the first voltage ELVDD and the second voltage ELVSS corresponding to the luminance value. Here, the information may be stored in the lookup table. Here, the storing may be performed prior to S830.

Accordingly, in S830, the voltage difference between the first voltage ELVDD and the second voltage ELVSS corresponding to the peak value detected in the S820 is detected using the information stored in the lookup table.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A display device comprising:

a panel comprising a plurality of pixel circuits, each of the pixel circuits comprising a light emitting element having one end coupled to a first voltage source for supplying a first voltage and another end coupled to a second voltage source for supplying a second voltage;

a controller for reducing image data for one frame and for outputting a control signal and a data signal to display an image corresponding to the reduced image data on the panel;

a voltage difference setting unit for detecting a peak value of the reduced image data and for calculating a driving voltage for generating a peak driving current corresponding to the peak value; and a power supply for generating the first and second voltages and for providing the first and second voltages to the panel in accordance with the calculated driving voltage, wherein the light emitting element of at least one of the pixel circuits is configured to receive the peak driving current.

2. The display device of claim 1, wherein the controller comprises an automatic current limit unit for receiving the image data for one frame, for reducing the image data to generate the reduced image data, and for outputting the reduced image data.

3. The display device of claim 2, wherein the automatic current limit unit is configured to reduce the image data for one frame by a subtraction amount to generate the reduced image data, and the automatic current limit unit is configured to set the subtraction amount to a value that is proportional to the brightness of the image displayed on the panel in accordance with the image data for one frame.

4. The display device of claim 3, wherein the image data comprises gray level data, and the automatic current limit unit is configured to output the reduced image data having a gray level of 0 when a difference obtained by subtracting the subtraction amount from the corresponding image data has a negative value.

5. The display device of claim 2, wherein the automatic current limit unit is configured to reduce the image data for one frame by a scale factor to generate the reduced image data, and the automatic current limit unit is configured to set the scale factor to a value that is proportional to the brightness of the image displayed on the panel in accordance with the image data for one frame.

6. The display device of claim 2, wherein the image data comprises red, green, and blue components of the image.

7. The display device of claim 1, wherein the voltage difference setting unit is configured to detect the peak value of the reduced image data, to calculate a peak luminance corresponding to the peak value using a gamma curve applied to the panel and the peak value, to calculate the peak driving current, and to calculate the driving voltage corresponding to the peak driving current.

8. The display device of claim 1, wherein the voltage difference setting unit comprises:

a peak value detector for receiving the reduced image data and for detecting a peak value of the reduced image data; and a driving voltage calculator for calculating the driving voltage corresponding to the peak driving current.

9. The display device of claim 8, wherein the driving voltage calculator comprises:

a peak driving current amount estimator for calculating a peak luminance corresponding to the peak value using a gamma curve applied to the panel and the peak value and for estimating a value of the peak driving current; and a voltage difference calculator for calculating the driving voltage in accordance with the estimated value of the peak driving current.

10. The display device of claim 8, wherein the voltage difference setting unit further comprises a lookup table for storing information on a luminance value and a driving voltage corresponding to the luminance value.

11. The display device of claim 10, wherein the voltage difference setting unit determines the driving voltage corresponding to the peak value using the information stored in the lookup table.

12. A driving method of a display device comprising a panel comprising a plurality of pixel circuits, each of the pixel circuits comprising a light emitting element having one end coupled to a first voltage source for supplying a first voltage and another end coupled to a second voltage source for supplying a second voltage, the method comprising:

reducing image data for one frame;

detecting a peak value of the reduced image data;

calculating a driving voltage to generate a peak driving current corresponding to the peak value; and generating the first and second voltages and providing the first and second voltages to the panel such that a voltage difference between the first and second voltages corresponds to the calculated driving voltage.

13. The method of claim 12, wherein, in the reduction of the image data, the image data for one frame is reduced by a subtraction amount to generate reduced image data, and the subtraction amount is a value that is proportional to the brightness of an image displayed on the panel by the image data for one frame.

14. The method of claim 13, wherein the image data comprises gray level data, and the driving method further comprises setting the reduced image data to gray level data having a value of 0 when a difference obtained by subtracting the subtraction amount from the corresponding image data has a negative value.

15. The method of claim 12, wherein, in the reduction of the image data, the image data for one frame is reduced by a scale factor, and the scale factor is set to a value that is proportional to the brightness of an image displayed on the panel by the image data for one frame.

16. The method of claim 12, wherein, in the reduction of the image data, the image data for one frame is reduced by a subtraction amount or by a scale factor.

17. The method of claim 12, wherein the calculation of the driving voltage comprises:

calculating a peak luminance corresponding to the peak value using a gamma curve applied to the panel and the peak value and estimating a value of the peak driving current; and calculating the driving voltage corresponding to the estimated value of the peak driving current.

18. The method of claim 12, further comprising storing information on a luminance value and a driving voltage corresponding to the luminance value.

19. The method of claim 18, wherein in the calculation of the driving voltage, the driving voltage corresponding to the peak value is determined using the stored information.

* * * * *